US006986928B2

(12) United States Patent
Almansa Perea

(10) Patent No.: US 6,986,928 B2
(45) Date of Patent: Jan. 17, 2006

(54) TABLECLOTH AND DEVICE FOR FIXING THE SKIRT OF SAID TABLECLOTH

(76) Inventor: Maria José Almansa Perea, Urb. Juan do Austria, Edif. Lapanto No. 307, 28280-El Escorial (Madrid) (ES)

( * ) Notice: Subject to any disclaimer, the term of this patent is extended or adjusted under 35 U.S.C. 154(b) by 289 days.

(21) Appl. No.: 10/276,363

(22) PCT Filed: May 14, 2001

(86) PCT No.: PCT/ES01/00187

§ 371 (c)(1),
(2), (4) Date: Nov. 15, 2002

(87) PCT Pub. No.: WO01/87126

PCT Pub. Date: Nov. 22, 2001

(65) Prior Publication Data

US 2003/0113508 A1 Jun. 19, 2003

(30) Foreign Application Priority Data

May 17, 2000 (ES) ..... 200001306 U
May 17, 2000 (ES) ..... 200001307 U

(51) Int. Cl.
*B32B 3/06* (2006.01)

(52) U.S. Cl. ..... 428/99; 428/100; 428/192; 428/194; 108/90; 150/158; 29/450; 160/330

(58) Field of Classification Search ..... 428/99, 428/100, 192, 194; 108/90, 56.3; 150/158; 29/450; 160/330
See application file for complete search history.

(56) References Cited

U.S. PATENT DOCUMENTS

| | | | | |
|---|---|---|---|---|
| 4,170,181 | A | 10/1979 | Glasgow | 108/50 |
| 4,708,183 | A | 11/1987 | Figueroa | 150/52 |
| 5,060,712 | A | 10/1991 | Ehrlich | 160/330 |
| 5,287,614 | A | 2/1994 | Ehrlich | 29/450 |
| 5,778,802 | A | 7/1998 | Hairston et al. | 108/90 |

FOREIGN PATENT DOCUMENTS

FR 2740957 5/1997

*Primary Examiner*—Nasser Ahmad
*Assistant Examiner*—Jane Rhee
(74) *Attorney, Agent, or Firm*—Collard & Roe, P.C.

(57) ABSTRACT

Improved tablecloth and device for fixing the skin of the tablecloth, the tablecloth comprising an independent skirt which can be detachably held to the board of the table by means which enable a variable distribution of the fixing points, and a cover which is placed on the surface of the table board and hanging sideways and hiding the edge of the board as well as the fixing points of the skirt. The device for fixing the skirt comprises a frame which is fixed to the lower part of the table board, and at a predetermined distance from the edge of the board, remaining slightly separated therefrom by discontinuous portions which can be integral with the frame or not. A variable number of C-shaped parts are placed on the frame which embrace it and are held by means of a narrowing section configured by its own branches, thereby enabling the lateral displacement along the frame. The portions are provided externally with Velcro-type bands to be fixed with their counter-parts which are sewn to the skirt, thereby making possible the displacement of the fixing points thus formed and a regular and esthetic distribution of the folds.

3 Claims, 2 Drawing Sheets

TABLECLOTH AND DEVICE FOR FIXING THE SKIRT OF SAID TABLECLOTH

CROSS REFERENCE TO RELATED APPLICATIONS

Applicant claims priority under 35 U.S.C. §119 of Spanish Application Nos. 0001306 and 0001307, filed on May 17, 2000. Applicant also claims priority under 35 U.S.C. §365 of PCT/ES01/00187, filed on May 14, 2001. The international application under PCT article 21(2) was not published in English.

OBJECT OF THE INVENTION

This invention refers to an improved tablecloth and tablecloth skirt attachment device. This tablecloth fits tables of different sizes and shapes due to its being fitted with a separate skirt. This skirt is attached by means of the device comprised within this invention.

ANTECEDENTS OF THE INVENTION

At present, due to tables of different sizes existing, it is necessary, if one wishes to achieve a suitable aesthetic appearance, to avail of different tablecloths of different sizes for each table shape and size.

This is usually a problem for companies including those in the hotelkeeping and restaurant business, given that it forces them to have different tablecloths depending upon the different sizes of tables, with the added problem, in the case of large-sized tables, of the tablecloth losing shape after several washings due to its shrinking more along one grain of the fabric, this being an effect which can be heightened even further by industrial pressing procedures.

In addition to the above, in the event of burns and other damage to the tablecloth, it must be discarded completely, wasting many meters of fabric which might still be used.

Apart from the above, to dress tables of the type used at banquets, head tables at social functions, etc., tablecloths and skirts, whether or not integrated into said tablecloths, concealing the table frame and improving its aesthetic appearance are usually used.

In the case of skirts separate from the tablecloths, these skirts are held in place using strips of Velcro fastened to strips of this same material attached to the underside of the tabletop. The problem involved in this way of attaching the skirt is that it is difficult to arrange the points at which the skirt is attached so that they will be spaced evenly and allow the folds in the skirt to fall evenly all around.

DESCRIPTION OF THE INVENTION

Due to its makeup and use, the improved tablecloth of the invention provides a optimum solution to the problems described above, given that it prevents the poor aesthetic appearance given by a tablecloth which has lost shape due to washing and/or industrial pressing, it affords the possibility of using one single size of tablecloth for different sizes of tables and, in the event of burns, etc. solely part of the tablecloth need be replaced, resulting in saving of a fabric being saved.

According to the invention, the tablecloth is comprised of two parts:

A piece to cover the tabletop, or cover, preferably made of cloth, the sole requirement with regard to size of which is that it completely cover said tabletop, hanging over the edges, as a result of which one single cover will serve to protect tabletops of different shapes and sizes, the edges hanging a shorter or longer distance off the floor.

A skirt, comprised of a preferably square piece of cloth which the attached to the tabletop mainly on the underside thereof using strips of Velcro, staples or any other means of varying the points of attachment, the free edge of which hangs down to the floor, covering the space exposed by the cover.

The skirt must be longer than the tabletop perimeter, and the points of attachment, as they are not fixed, afford the possibility of arranging the same individually on the tables of different shapes and sizes so that, with one single skirt of a certain length, tables of different perimeters can be dressed by changing the billow of the flares or folds evenly, the width of the skirt being constant, given that the distance from the tabletop to the floor is practically constant for any table.

The skirt attachment points and the edge of the tabletop are concealed behind the hanging portions of the cover, the table statically being the same as a table dressed with a full tablecloth and tablecloth cover.

Therefore, with a few different-sized tabletop covers and skirts, any table can be dressed, in addition to the fact that in the event that the tabletop cover is burned or irreparably stained, only the tabletop cover need be discarded, the skirt still being suitable for use.

The skirt is held in place preferably by means of a device comprised of a frame which is attached to the underside of the tabletop and which is equipped with some spacers so that, when the device is attached to the tabletop, it sets out slightly from it.

This frame is preferably similar in shape to the shape of the tabletop proper and is located a certain distance from the edge of the tabletop.

Some flat pieces, which are folded into a "C" shape, are inserted into the frame along the outside of the tablecloth, clamping it down, these pieces being fitted with a strip of Velcro on the part facing the outer edge of the table.

Each one of these pieces is secured to the frame by means of a piece which juts out from them by catching configured by the sides of the "C".

Therefore, the pieces can be moved around the frame such that, when attaching the skirts, it will be easy, by moving them from one position to another, to arrange the points of attachment, providing an aesthetic effect of a regular arrangement thereof

DESCRIPTION OF ONE EMBODIMENT OF THE INVENTION

Figure 1:
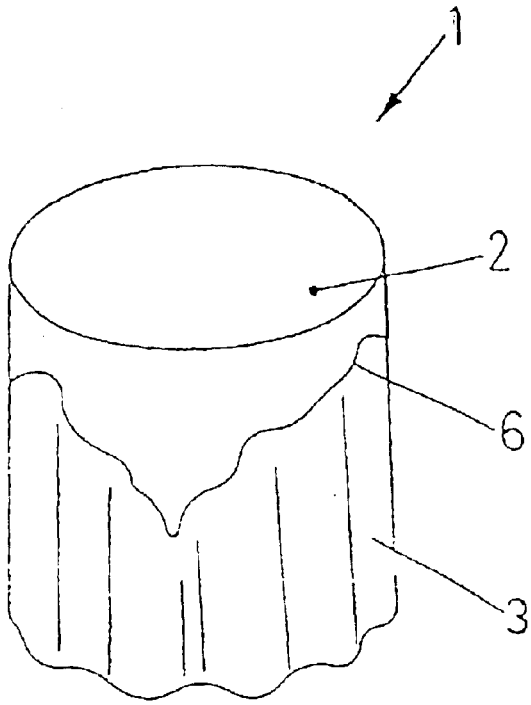
FIG. 1 provides one view of the tablecloth of the invention.
Figure 2:
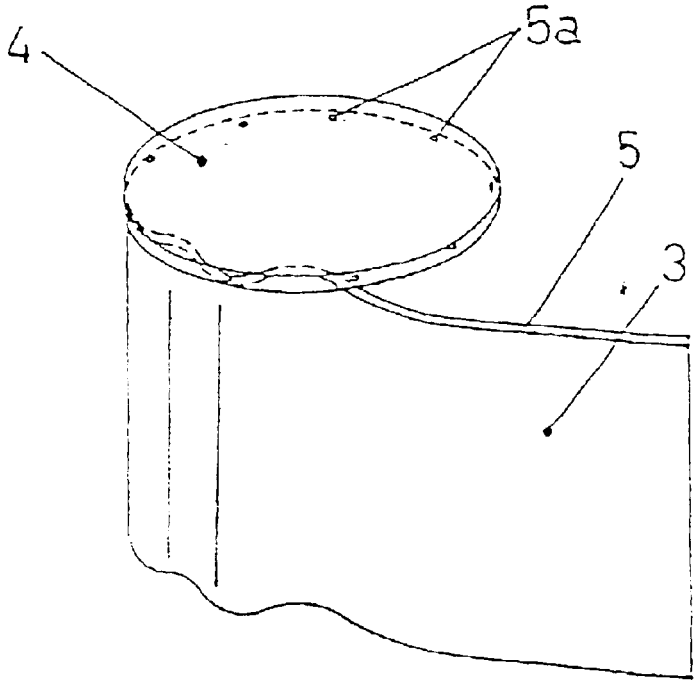
FIG. 2 shows the placement of the skirt of the tablecloth of the invention.
Figure 3:
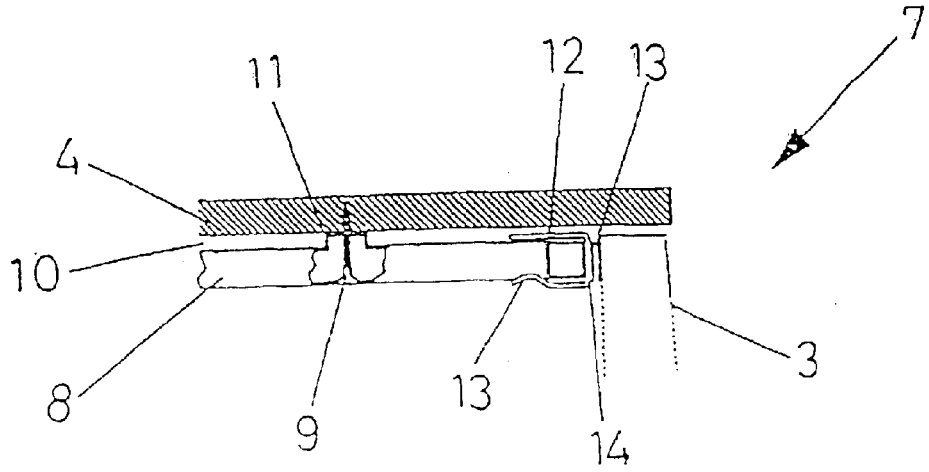
FIG. 3 shows one section of the skirt attachment device.
Figure 4:
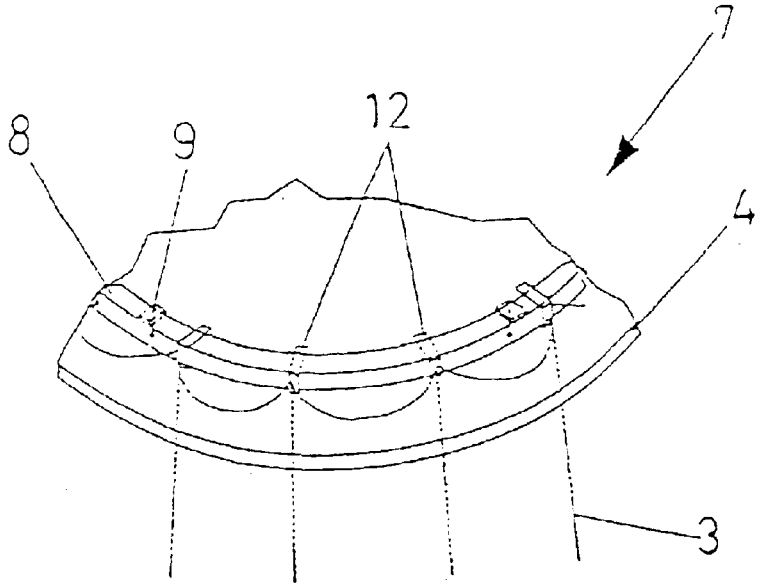
FIG. 4 shows a perspective view of the skirt attachment device.

The tablecloth (1) of the invention is comprised of a cover (2) and a skirt (3).

The skirt is attached to the underside of the tabletop (4) by means of and end strip (5) of Velcro, which is affixed to opposite sides (5$^a$) of the same material which are stapled, glued, screwed, etc. into place on the underside of the tabletop so that on same size of skirt can be attached to tabletops of different sizes by selecting the points of attachment such that the folds will hang evenly, always under the condition that the skirt be of the same or of a longer length that the perimeter of the tabletop.

The cover is placed on the top side, covering the tabletop and hanging off the side concealing both the edge of the tabletop as well as the points at which the skirt is attached, the edges of the cover (6) being a shorter or longer distance from the floor depending upon the size of the tablecloth, which is thus ready for use.

To attach the skirt (3), a device (7) is preferably used, which is comprised of a frame (8) which is attached to the underside of the tabletop (4) by means of screws (9), a small space (10) being left between the two thanks to some pieces (11) jutting out from the frame holding the frame in place up against the tabletop.

One of the ends of a "C"-shaped piece (12) is inserted into one of the ends of said space, the other end of said piece having an overhanging piece (13) which helps to attach the piece to the frame, preventing it from accidentally slipping out, but allowing it to slide around the frame.

On the outside (14) of the piece (12), is a strip (13) of Velcro to which the opposite piece of the same material stitched to the skirt (3) is adhered.

Therefore, thanks to the moving of the pieces (12), the skirt attachment points can be arranged evenly, improving the aesthetics of the tablecloth.

What is claimed is:

1. An improved tablecloth and tablecloth attachment device assembly comprising a tablecloth having (a) a separate skirt detachably secured at skirt attachment points to an underside of a tabletop and (b) a cover placed on the tabletop and hanging sideways on the tabletop, said skirt having means for changing distribution of the skirt attachment points, said cover concealing an edge of the tabletop and the skirt attachment points.

2. The assembly according to claim 1 wherein the means for changing distribution comprises a first strip of hook or loop fasteners placed along an upper edge or the skirt and a second strip of mating hook or loop fasteners arranged on the underside of the tabletop for attachment to said first strip.

3. The assembly according to claim 1 wherein said assembly comprises:

(a) a frame attached to an underside of the tabletop at a selected distance the tabletop edge, said frame being spaced from the tabletop underside by discontinuous pieces;

(b) a plurality of C-shaped parts clamped to the frame comprising branching sections, said C-shaped pares being held by a narrowing section of said branching sections, thereby enabling lateral displacement of said C-shaped parts along the frame; and (c) a plurality of hook or loop fastener stripe attached to an outside or said C-shaped parts and attached to mating hook or loop fastener strips sewn to the skirt, thereby permitting displacement of the skirt attachment points for arranging a regular and aesthetic distribution of tablecloth folds.

* * * * *

UNITED STATES PATENT AND TRADEMARK OFFICE

CERTIFICATE OF CORRECTION

PATENT NO. : 6,986,928 B2
DATED : January 17, 2006
INVENTOR(S) : Almansa Perea

It is certified that error appears in the above-identified patent and that said Letters Patent is hereby corrected as shown below:

Column 4,
Line 16, after "distance" add -- from --.
Line 20, change "pares" to -- parts --.
Line 24, change "stripe" to -- strips --.
Line 25, change "or" to -- of --.

Signed and Sealed this

Sixteenth Day of May, 2006

JON W. DUDAS
*Director of the United States Patent and Trademark Office*